US005203402A

United States Patent [19]

Nishishita et al.

[11] Patent Number: 5,203,402

[45] Date of Patent: Apr. 20, 1993

[54] HEAT EXCHANGER

[75] Inventors: Kunihiko Nishishita, Konan; Amane Watanabe, Higashi-Matsuyama; Isamu Kurosawa, Konan; Yokichi Sato, Tokyo, all of Japan

[73] Assignees: Zexel Corporation; Nihon Parkerizing Co., Ltd., both of Tokyo, Japan

[21] Appl. No.: 836,127

[22] Filed: Feb. 14, 1992

[30] Foreign Application Priority Data

Feb. 18, 1991 [JP] Japan ..... 3-45770

[51] Int. Cl.[5] ..... F28F 13/18

[52] U.S. Cl. ..... 165/133; 165/134.1

[58] Field of Search ..... 165/133, 134.1

[56] References Cited

U.S. PATENT DOCUMENTS 4,830,101 5/1989 Ohara et al. ..... 165/133

FOREIGN PATENT DOCUMENTS 58-2596 1/1983 Japan ..... 165/133
59-185996 10/1984 Japan ..... 165/133
60-101156 6/1985 Japan ..... 165/133
60-45776 10/1985 Japan .
62-105629 5/1987 Japan ..... 165/133
63-249643 10/1988 Japan ..... 165/133
2-150695 6/1990 Japan ..... 165/133

*Primary Examiner*—Allen J. Flanigan
*Attorney, Agent, or Firm*—Frishauf, Holtz, Goodman et al.

[57] ABSTRACT

A heat exchanger having outer surfaces thereof coated with a hydrophilic coating layer. The hydrophilic coating layer essentially consists of a resin as a base, containing a colloidal silica. In the hydrophilic coating layer, part of silanol groups of the colloidal silica are chemically combined with part of hydroxyl groups of the resin. Due to this chemical combination, the colloidal silica undergoes change in its properties such that it has degraded adsorptivity, making smells less liable to attach to the colloidal silica.

3 Claims, 4 Drawing Sheets

HEAT EXCHANGER

BACKGROUND OF THE INVENTION

1. Field of the Invention

This invention relates to a heat exchanger, such as an evaporator for use in air-conditioning systems for automotive vehicles, and more particularly to a heat exchanger of this kind having outer surfaces thereof coated with hydrophilic coating layers.

2. Background Information

Conventionally, a heat exchanger of this kind has been proposed e.g. by Japanese Patent Publication (Kokoku) No. 60-45776, which comprises a plurality of tube elements, each of which is composed of a pair of stamped plates joined together to define flat refrigerant-evaporating passages therebetween, and a plurality of corrugated fins interposed between adjacent tube elements, the tube elements and the corrugated fins being superposed one upon another in an alternate manner, wherein the outer surfaces of the stamped plates and the corrugated fins are coated with hydrophilic coating layers. The hydrophilic coating layers generally contain approx. 80% of colloidal silica and approx. 20% of alkali silicate (water glass) $K_2O.3SiO_2$. The hydrophilic coating layers improve the hydrophilic property of the surfaces of the corrugated fins and the tube elements, which concerns the resistance of condensate deposited thereon to the air flow.

In such a conventional heat exchanger, in general, the higher the colloidal silica content, the smaller the contact angle $\theta$ formed between the surface of a solid object and the surface of a liquid drop on the solid object (an angle formed at a point where the surface of a liquid drop is in contact with the surface of a solid object between a tangent to the liquid drop surface at the point and the solid object surface), as shown in FIG. 3*a*, i.e. the more desirable the hydrophilic property of the surfaces, whereas the smaller the colloidal silica content, the larger the contact angle $\theta$, as shown in FIG. 3*b*, i.e. the poorer the hydrophilic property of the same.

Although the colloidal silica contributes to enhancing the hydrophilic property of a material mixed therewith, it also has a strong adsorptivity. Therefore, smells, such as a smell of dust or an initial smell of a new manufactured article, are liable to be adsorbed by the colloidal silica, and the heat exchanger may omit the smells, e.g. when an air-conditioning system incorporating the heat exchanger and installed on an automotive vehicle is stopped, so that the smells, which may be offensive to occupants of the vehicle, are fed into the passenger compartment of the vehicle. In short, the colloidal silica can generate offensive smells. Therefore, there has been a demand for a hydrophilic coating layer which is excellent in hydrophilic property but is not liable to generate offensive smells.

SUMMARY OF THE INVENTION

It is the object of the invention to provide a heat exchanger which has surfaces thereof possessing an excellent hydrophilic property but is not liable to produce offensive smells.

To attain the above object, the present invention provides a heat exchanger having outer surfaces thereof coated with a hydrophilic coating layer.

The heat exchanger according to the invention is characterized in that the hydrophilic coating layer consists essentially of a resin as a base, containing colloidal silica, part of the silanol groups of the colloidal silica being chemically combined with part of the hydroxyl groups of the resin.

According to the heat exchanger of the invention, in the hydrophilic coating layer, part of the silanol groups of the colloidal silica are chemically combined with part of the hydroxyl groups of the resin. Due to this chemical combination, the colloidal silica undergoes a change in part of its properties such that it has degraded adsorptivity, whereby smells are less liable to be attached to the colloidal silica. Further, although the hydrophilic property of the colloidal silica slightly decreases due to this chemical combination, the hydroxyl groups of the resin contribute to improving the hydrophilic property, and hence the hydrophilic coating layer as a whole has sufficiently high hydrophilic property. Therefore, there can be obtained a heat exchanger which has a desirable hydrophilic property, but is not liable to produce offensive smells.

Preferably, the hydrophilic coating layer contains 10 to 40% by weight of colloidal silica, whereby the hydrophilic property is further improved, and offensive smells are less liable to be produced.

The above and other objects, features, and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
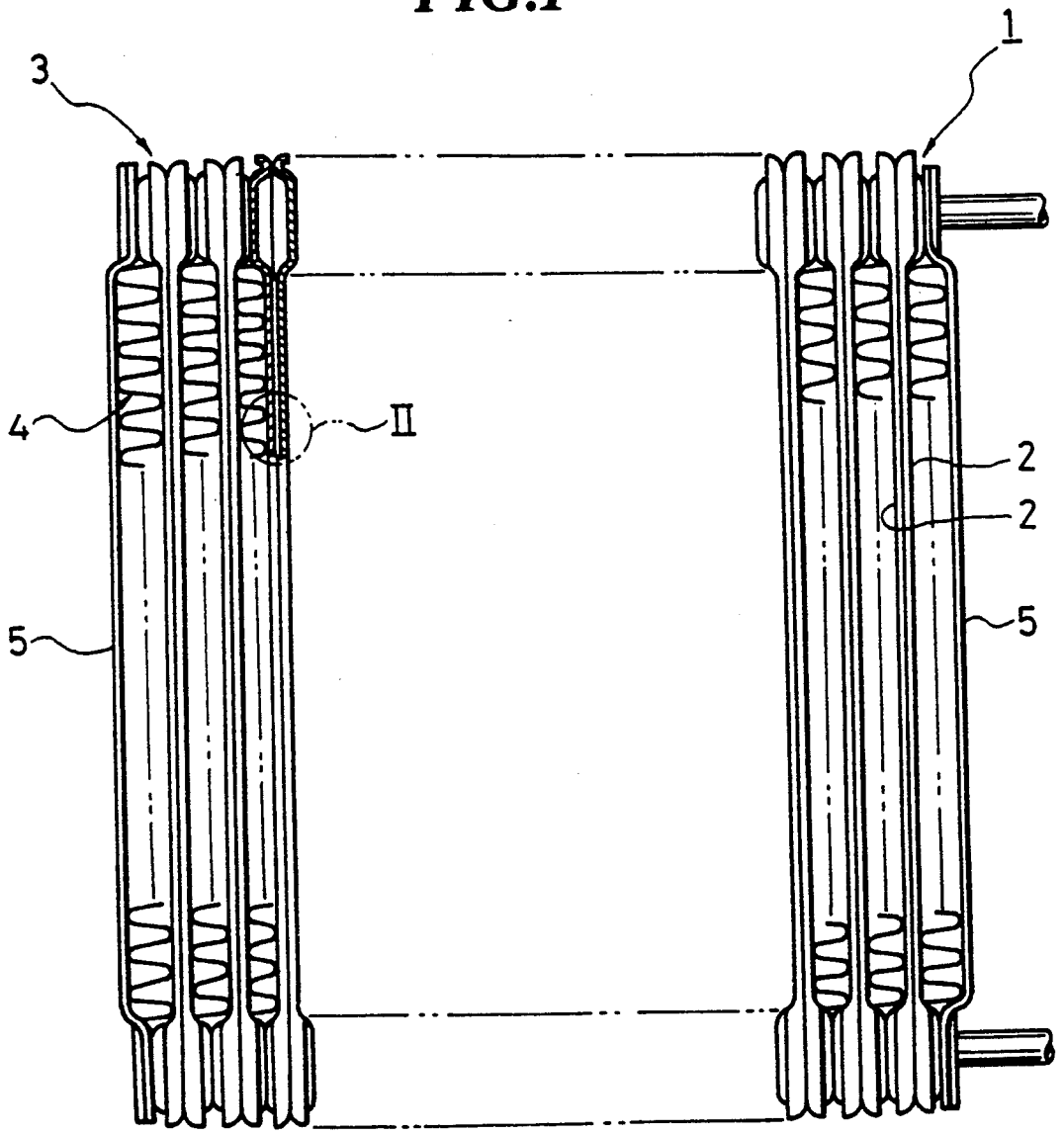
FIG. 1 is an elevational view, partly in section, of a heat exchanger according to an embodiment of the invention.

FIG. 1 shows the whole of a laminate type evaporator (heat exchanger) according to the embodiment of the invention.

As shown in FIG. 1, the laminate type evaporator comprises a number of tube elements 3, each of which is composed of a pair of stamped plates 3, 3 joined together to form a refrigerant-evaporating passage 2*a* (see FIG. 2) therebetween, a number of corrugated fins 4, the tube elements and the corrugated fins being superposed one upon another in an alternate manner, and a pair of end plates 5, 5 are attached to outermost tube elements at opposite ends thereof. The evaporator 1, which has top and bottoms thereof and right and left ends thereof are covered with a casing, not shown, is disposed so that cooling air is introduced into the evaporator in a direction perpendicular to the plane of FIG. 1 to pass through air passages defined through the corrugated fins 4.

The laminate type evaporator having the above construction is fabricated as follows: First, the stamped plates 2 and the end plates 5 are prepared by stamping sheets of a metal which has high thermal conductivity, e.g. aluminum, into respective shapes. Then, the surfaces of the stamped plates and end plates thus formed are coated with a brazing material. The stamped plates 2, corrugated fins 4 and end plates 5 are assembled and held in the assembled state by means of a suitable jig (not shown). Next, the assembly is heated under a predetermined brazing atmosphere so that the brazing material is melted to join the contact portions of the component parts together.

Figure 2:
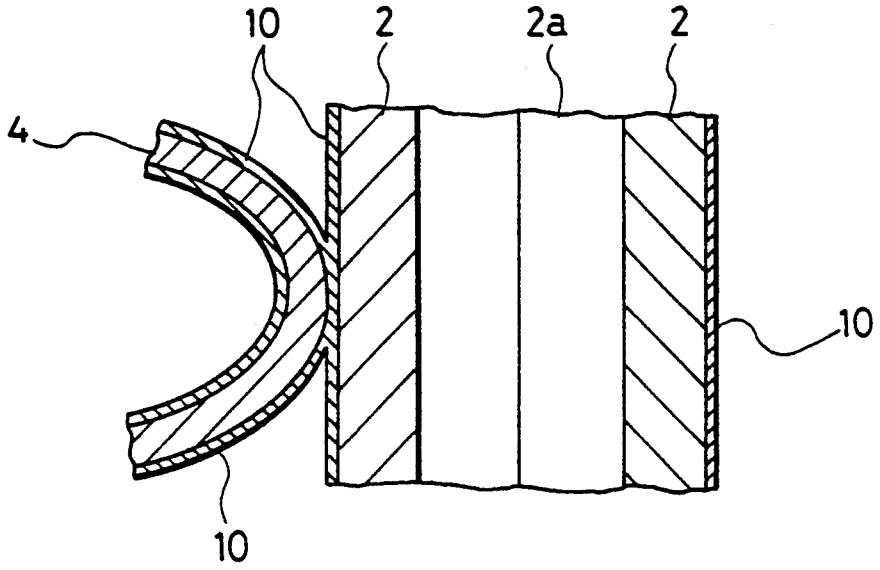
FIG. 2 is an enlarged fragmentary sectional view of a portion encircled by symbol II in FIG. 1.
Figure 3A:
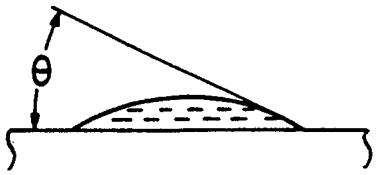
FIG. 3*a* is a schematic diagram which shows the hydrophilic property of a solid object surface.
Figure 3B:
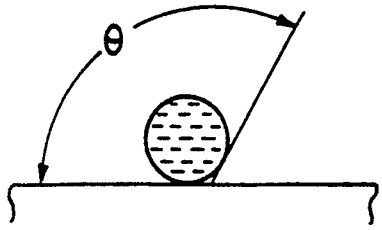
FIG. 3*b* is a schematic diagram which shows the hydrophilic property of a solid object surface.

As shown in FIG. 2, the outer surfaces of the stamped plates 2 and the corrugated fins 4 assembled are coated with a hydrophilic coating layer 10 by means of a hydrophilic property-imparting treatment. The hydrophilic coating layer 10 is formed of a resin as a base, such as an acrylic-modified resin of polyamide-epichlorohydrin, containing colloidal silica in an amount of 10 to 40% by weight. Further, in the layer 10, part of silanol groups (—Si—O—H) in the colloidal silica are chemically combined with part of hydroxyl groups (—OH) of the resin.

An example of the hydrophilic property-imparting treatment will be described hereinbelow.

First, the evaporator 1 assembled and held in the assembled state by the brazing step as described above is immersed in an etching bath containing an etching solution to clean and degrease the same and thereby protect the surfaces of the tube elements 3, corrugated fins 4, and end plates 5 from being oxidized, followed by washing the assembly with water to remove the etching liquid therefrom. Then, the surfaces of the component parts are coated with a chromic acid anodic oxide coating to prevent corrosion thereof.

The above steps are repeated several times.

Then, the evaporator 1 is immersed in a bath of a treatment of an aqueous solution of an acrylic-modified resin of polyamide-epichlorohydrin as a polyamide resin, and colloidal silica. The treatment is prepared by diluting a stock solution with water. The stock solution is a mixture of an aqueous solution of colloidal silica which has been made cationic by an additive formed by aluminium nitrate ($A1(NO_3)_3$), and an aqueous solution of an acrylic-modified resin of polyamide-epichlorohydrin. In this mixture, part of the silanol groups (—Si—O—H) in the colloidal silica are chemically combined with part of the hydroxyl groups (—OH) in the resin.

After the immersion, the evaporator 1 is placed into a centrifugal separator. Then, the centrifugal separator is rotated at a predetermined rotational speed for a predetermined period of time at normal temperature so that the treatment associated with the tube elements 3 and corrugated fins 7 is reduced to a predetermined quantity in terms of weight per evaporator.

Finally, the evaporator is dried in a drying chamber at a temperature of 130° C. for 20 minutes.

Thus, the hydrophilic coating layer 10 is formed on the outer surfaces of the stamped plates 2 and corrugated fins 4.

Next, results of a condensate-scattering test and a smell test conducted on the hydrophilic coating layer 10 formed in the above described manner will be explained.

Figure 4:
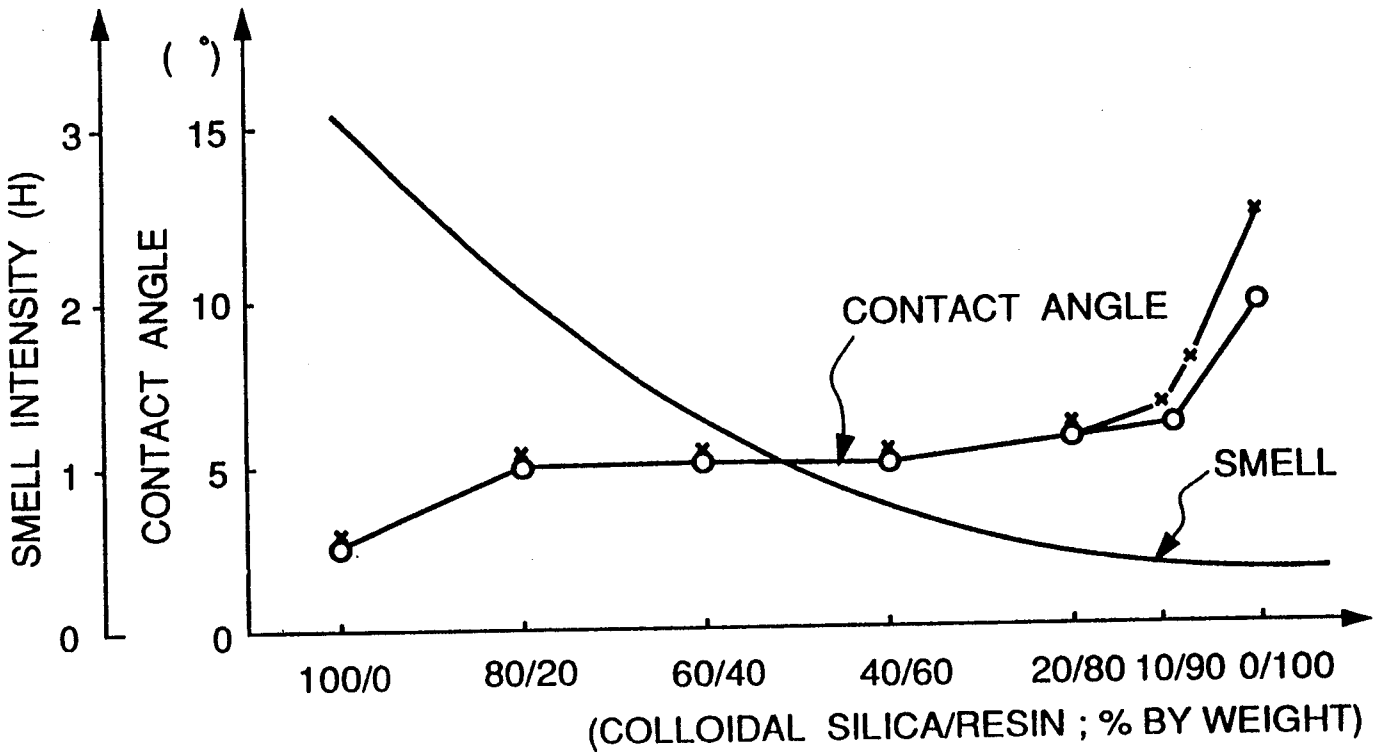
FIG. 4 is a graph showing the results of condensate-scattering tests and smell tests conducted on hydrophilic coating layers with different ratios of the colloidal silica content to the resin content.

Several samples of the hydrophilic layer 10 were formed, which had different ratios of the colloidal silica content to the resin content, and a condensate-scattering test and a smell test were carried out on these samples. FIG. 4 shows results of the tests. In FIG. 4, symbol ○ represents an initial value of the contact angle, while symbol x represents a value of the contact angle obtained by a water running test, in which pure water was poured onto the evaporator 1 to wash the surfaces thereof.

As is apparent from FIG. 4, in samples whose colloidal silica content is above 40% by weight, the contact angle assumed values equal to or lower than 5°, both before (initial value) and after the water running test, which indicates that the hydrophilic property of the samples having the colloidal silica content exceeding 40% by weight is excellent, but the smell intensity (H) sharply increases from approximately 0.8 as the silica content increases from 40% by weight. Therefore, the hydorphilic coating layers having the colloidal silica content exceeding 40% by weight are not acceptable, due to its high smell intensity (H).

On the other hand, in samples whose colloidal silica content is below 10% by weight, the smell intensity (H) assumed values well below 1, which indicates that the samples do not produce offensive smell, but both the initial value of the contact angle and the value of the same after the water running test sharply increase as the colloidal silica content decreases, resulting in a remarkable degradation in the hydrophilic property. Therefore, the hydrophilic coating layers 10 having the colloidal silica content lower than 10% by weight are not acceptable, due to lack of sufficient hydrophilic property.

In contrast, in the case of samples whose colloidal silica content falling within the range of 10 to 40% by weight, both the initial value of the contact angle and the value of the same after the water running test are approximately 5°, which indicates that the samples have excellent hydrophilic property, and at the same time the smell intensity (H) is equal to or lower than 0.8, which indicates that the hydrophilic coating layers do not produce offensive smells and therefore are acceptable.

Figure 5:
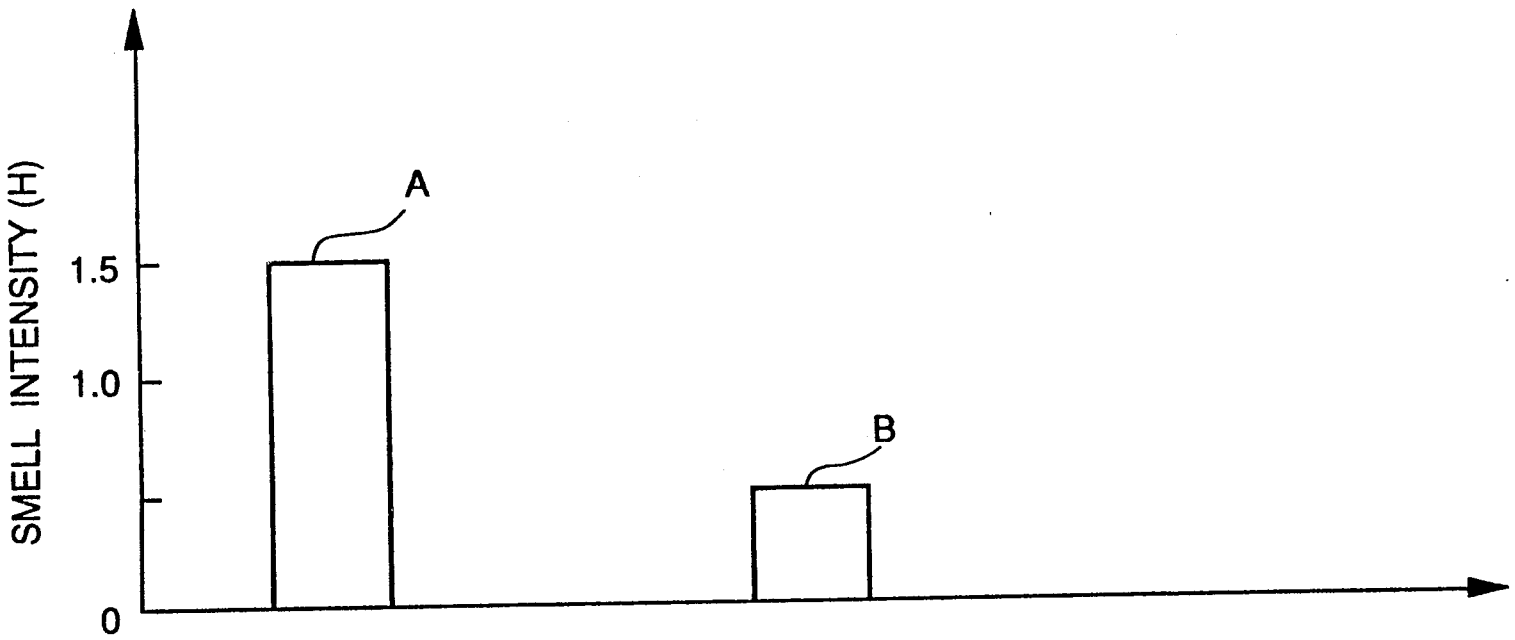
FIG. 5 is a graph showing smell intensity (H) in the case of a conventional hydrophilic coating layer A and a hydrophilic coating layer B according to the invention.

FIG. 5 shows smell intensity (H) in the case of the above-mentioned conventional hydrophilic coating layer A containing a colloidal silica and water glass, and a hydrophilic coating layer B (10) obtained by the above described embodiment of the invention. As is apparent from FIG. 5, the conventional hydrophilic coating layer A assumes a smell intensity (H) value of approx. 1.5, but in contrast, the hydrophilic coating layer B according to the invention assumes as small as approx. 0.5.

Although in the above embodiment, the invention is applied to a laminate type evaporator, this is not limitative but the invention may also be applied to all the other types of heat exchangers.

What is claimed is:

1. In a heat exchanger including a plurality of tube elements, each of said tube elements having a refrigerant-evaporating passage formed therethrough, and corrugated fins associated with said tube elements, wherein said tube elements and said corrugated fins have outer surfaces thereof coated with a hydrophilic coating layer, the improvement wherein said hydrophilic coating layer comprises a colloidal silica having silanol groups, the colloidal silica being made cationic by combining aluminum nitrate with an acrylic-modified resin of polyamide-epichlorohydrin having hydroxyl groups, part of the silanol groups of said colloidal silica being chemically combined with part of the hydroxy groups of said acrylic-modified resin of polyamide-epichlorohydrin.

2. A heat exchanger according to claim 1, wherein said hydrophilic coating layer contains 10 to 40% by weight of colloidal silica.

3. The heat exchanger according to claim 1, wherein the outer surface of the tube elements is an aluminum surface.

* * * * *